US005295843A

United States Patent [19]

Davis et al.

[11] Patent Number: 5,295,843

[45] Date of Patent: Mar. 22, 1994

[54] ELECTRICAL CONNECTOR FOR POWER AND SIGNAL CONTACTS

[75] Inventors: Wayne S. Davis, Harrisburg; Robert N. Whiteman, Jr., Middletown; David A. Griesemer, Harrisburg, all of Pa.

[73] Assignee: The Whitaker Corporation, Wilmington, Del.

[21] Appl. No.: 5,690

[22] Filed: Jan. 19, 1993

[51] Int. Cl.[5] ..... H01R 23/70

[52] U.S. Cl. ..... 439/108; 439/637; 439/924

[58] Field of Search ..... 439/95, 108, 637, 507, 439/924

[56] References Cited

U.S. PATENT DOCUMENTS 3,231,848 1/1966 Ruehlemann ..... 439/637
3,760,335 9/1973 Roberts ..... 339/99 R
4,790,763 12/1988 Weber et al. ..... 439/681
4,917,616 4/1990 Demler, Jr. et al. ..... 439/101
4,975,069 12/1990 Fedder et al. ..... 439/101
4,976,628 12/1990 Fedder ..... 439/101

FOREIGN PATENT DOCUMENTS 0026978 3/1978 Japan ..... 439/637

*Primary Examiner*—Eugene F. Desmond
*Attorney, Agent, or Firm*—Gerald K. Kita

[57] ABSTRACT

An electrical connector (1) comprising: an insulative housing (2), multiple pairs (3) of conductive signal contacts (4, 5) distributed along an insulative divider (7) within the housing (2) and adapted to be connected to respective pairs of signal wires (27), at least one conductive power contact (6) having a pair of contact fingers (9) on opposite sides of the divider, (7), the contact fingers (9) having a surface area sufficiently broad to radiate heat resulting from electrical power dissipation.

14 Claims, 7 Drawing Sheets

26
8
11
2
18
16
6
20
22
33
34
31
21
13
28
29
30
27
10

26
14
19
8
21
18
17
22
32
33
31
7
9
20
15
34

26
14
19
8
21
16
4
22
27
7
5
20
15

ELECTRICAL CONNECTOR FOR POWER AND SIGNAL CONTACTS

FIELD OF THE INVENTION

The present invention relates to an electrical connector having electrical contacts for transmitting electrical power and electrical signals in a single connector.

BACKGROUND OF THE INVENTION

An electrical connector, known from U.S. Pat. No. 3,760,335, comprises, an insulating housing and conductive signal contacts. The contacts are grouped in pairs, with an insulative divider of the housing separating one contact of the pair from the other contact of the pair. Multiple pairs of the contacts are distributed along the insulative divider. The pairs of contacts are especially suitable for connection to twisted pair wires used in the communications industry for data and voice transmission. Each pair of the twisted pair wires are connected to one pair of the contacts. The signal contacts, known from U.S. Pat. No. 3,760,335, are suitable for transmitting electrical signals of relatively low power, but are of inadequate mass and surface area to dissipate heat from electrical power transmission. The usual practice has been to route electrical power over an electrical cable that is separate from the twisted pair wires, and connecting the cable with an electrical connector that is separate from the connector connected to the signal wires. A single electrical connector for both signal contacts and at least one power contact would eliminate a need for separate connectors.

Another version of the connector, a single connector for both signal contacts and at least one power contact is suitable for connection to a circuit board.

SUMMARY OF THE INVENTION

According to a feature of the invention, an electrical connector comprises both signal contacts and at least one power contact in the same insulative housing. An electrical connector according to the invention is suitable for connection to twisted pair wires and to conductors of an electrical power cable. According to another embodiment of the invention, an electrical connector is suitable for connection to both signal and power conductors routed on a circuit board.

An electrical connector comprises, an insulative housing, multiple pairs of conductive signal contacts distributed along an insulative divider within the housing and adapted to be connected to respective pairs of signal wires, at least one conductive power contact having a pair of contact fingers on opposite sides of the divider, the contact fingers having a surface area sufficiently broad to radiate heat from electrical power dissipation.

DESCRIPTION OF THE DRAWINGS

Embodiments of the invention will now be described by way of example with reference to the drawings according to which;

With reference to FIG. 1, each of two embodiments of an electrical connector 1 comprises, an insulative housing 2, multiple pairs 3 of conductive signal contacts 4, 5, accompanied by at least one power contact 6, in the housing 2. The pairs 3 of the signal contacts 4, 5 are distributed along an insulative divider 7 in an interior 8 of the housing 2. The signal contacts 4, 5 of each pair 3 are on opposite sides of the divider 7 that separates the signal contacts 4, 5 of each pair 3. The signal contacts 4, 5 are in rows, and are parallel to one another. A pair of contact fingers 9 on the power contact 6 are on opposite sides of the divider 7, and extend parallel to the signal contacts 4, 5. The surface area of each of the fingers 9 is larger than that of each of the signal contacts 4, 5, and is sufficiently broad to radiate heat from electrical power dissipation. In addition, each of the fingers 9 is of greater mass than each of the signal contacts 4, 5 to carry electrical current. When electrical current is transmitted by the power contact 6, dissipation of electrical power generates heat. The heat is radiated from the surface area of the power contact 6. A larger surface area and a higher mass of the power contact 6 will limit the temperature attained by the power contact 6.

Figure 1:
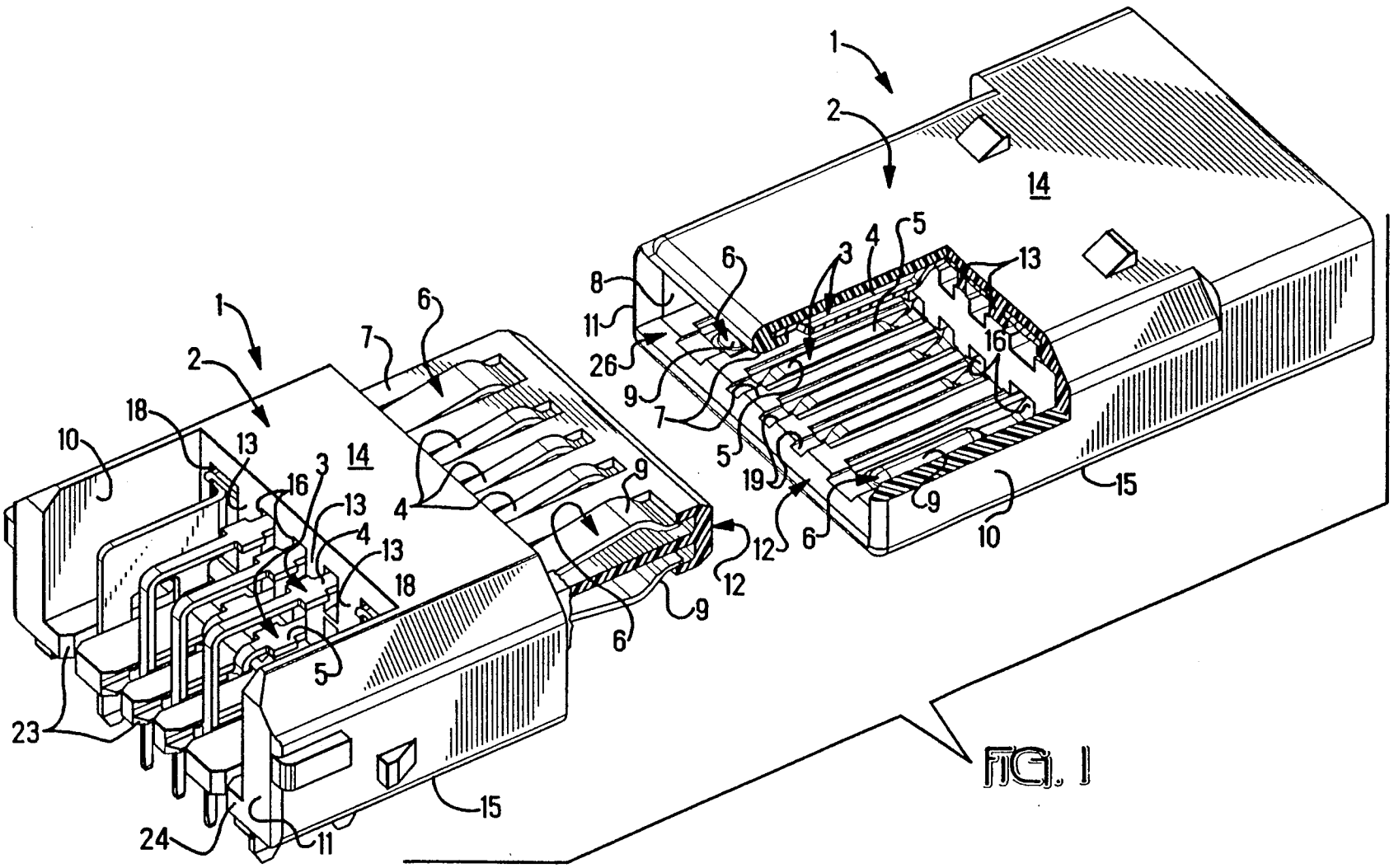
FIG. 1 is a fragmentary perspective view of two electrical connectors.

The divider 7 bridges between, and is joined to side walls 10, 11 of the housing 2. The divider 7 extends from a front mating end 12 of the housing 2 and rearwardly in the interior 8 of the housing 2. Spaced apart partitions 13 in the interior 8 bridge between the divider 7 and a top wall 14 of the housing 2, and between the divider 7 and a bottom wall 15 of the housing 2. The partitions 13 join the divider 7 and the top and bottom walls 14, 15. The walls 14, 15 bridge between and join the side walls 10, 11 to form the exterior of the housing 2. Contact receiving cavities 16 in the housing 2 are defined between the partitions 13 and extend behind the divider 7 to receive the signal contacts 4, 5. With respect to the power contact 6, FIGS. 3 and 9, the fingers 9 are connected to a body portion 17 having a surface area sufficiently broad to radiate heat from electrical power dissipation. A pocket 18 in the housing 2, between a side wall 12, 15 and a partition 13, and behind the divider 7, receives the body portion 17. Each of the contact receiving cavities 16 is smaller than the pocket 18. The power contact 6 can be inserted in the housing 2 unmistakenly in the pocket 18 that is larger than each of the smaller, contact receiving cavities 16 that is smaller than the body portion 17. The divider 7 extends forwardly of the partitions 13, and is provided with a series of grooves 19 on its opposite sides aligned with the contact receiving passages. The grooves 19 receive the signal contacts 4, 5 and the contact fingers 9. The grooves 19 that receive the contact fingers 9 are larger than the grooves 19 that receive the signal contacts 4, 5. Projecting lances 20 on each signal contact 4, 5 and on the power contact 6 impinge against walls 21 of the housing 2, and resist withdrawal of the contacts 4, 5 and 6 from the grooves 19. Each of the signal contacts 4, 5 and the power contact 6 is of unitary construction, stamped and formed from a strip of metal.

With respect to FIGS. 1 and 2–7, a version of the connector 1 for mounting on a circuit board, not shown, will be described. The divider 7 is spaced apart from the top and bottom walls 14, 15 of the housing 2. The grooves 19 face toward the top and bottom walls 14, 15. The pairs 3 of signal contacts 4, 5 are adapted to be connected to a circuit board, not shown. An electrical termination 22 in the form of a post extends laterally downward from each of the signal contacts 4, 5 for connection to a circuit board, not shown, and more particularly, to a plated aperture, not shown of the circuit board. The terminations 22 extend laterally downward by bending the signal contacts 4, 5 along their lengths, the signal contact 4 being longer in length than the signal contact 5.

Figure 2:
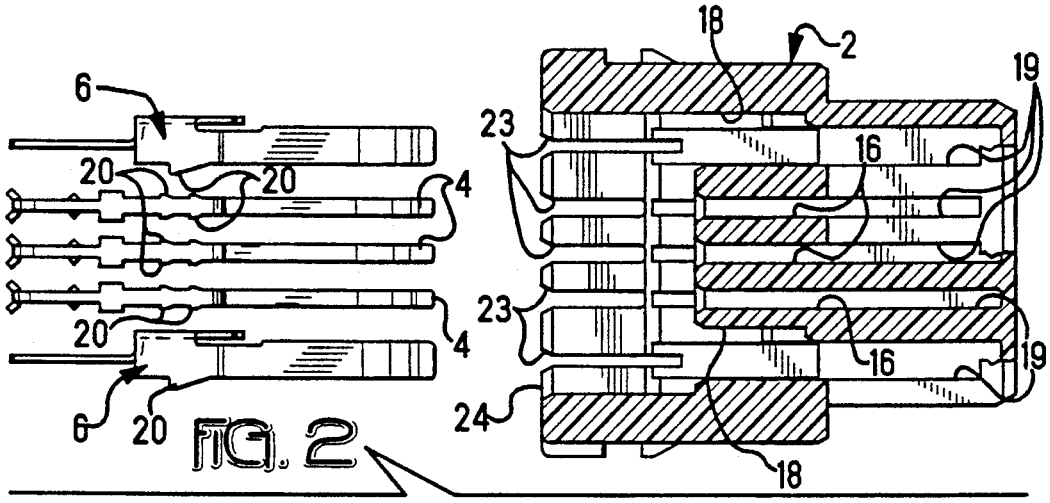
FIG. 2 is a section view of one of the connectors shown in FIG. 1 with parts separated from one another.
Figure 3:
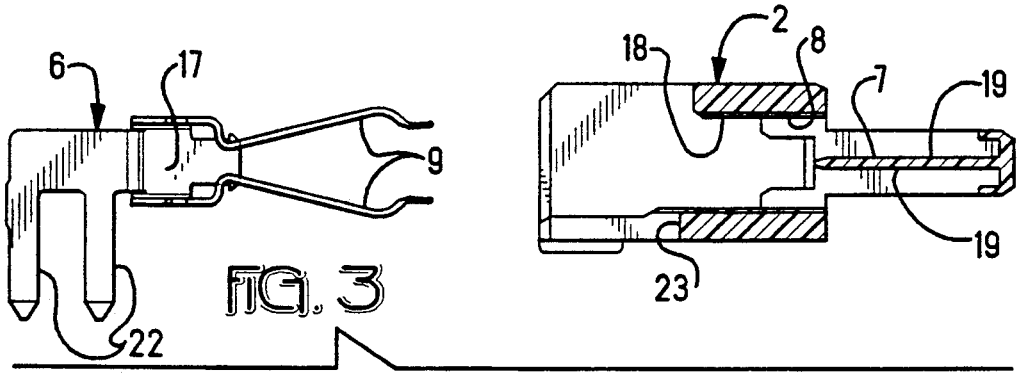
FIG. 3 is a section view of a portion of the connector shown in FIG. 2.
Figure 4:
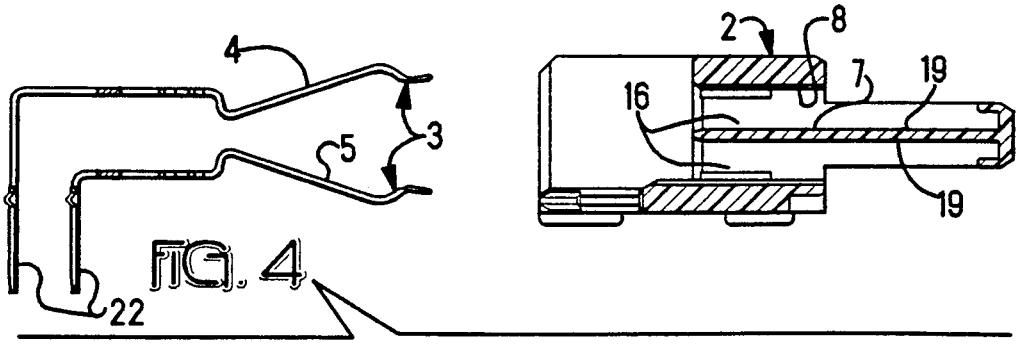
FIG. 4 is a section view of a portion of the connector shown in FIG. 2.
Figure 5:
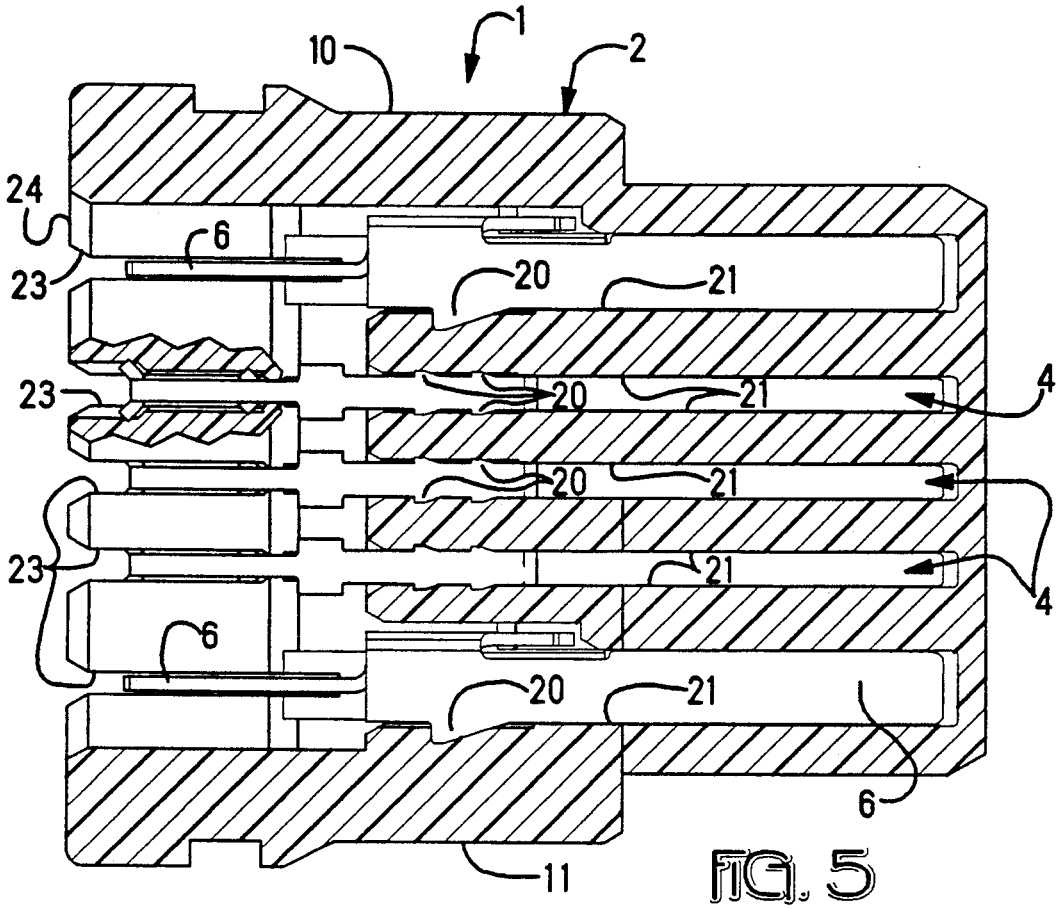
FIG. 5 is a view similar to FIG. 2 with the parts assembled together.
Figure 6:
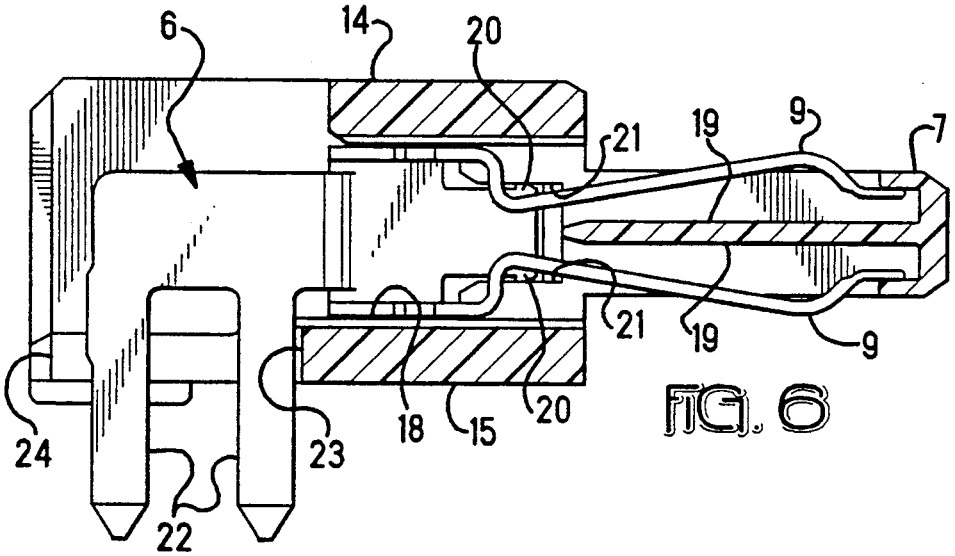
FIG. 6 is a view similar to FIG. 3 with the parts assembled together.
Figure 7:
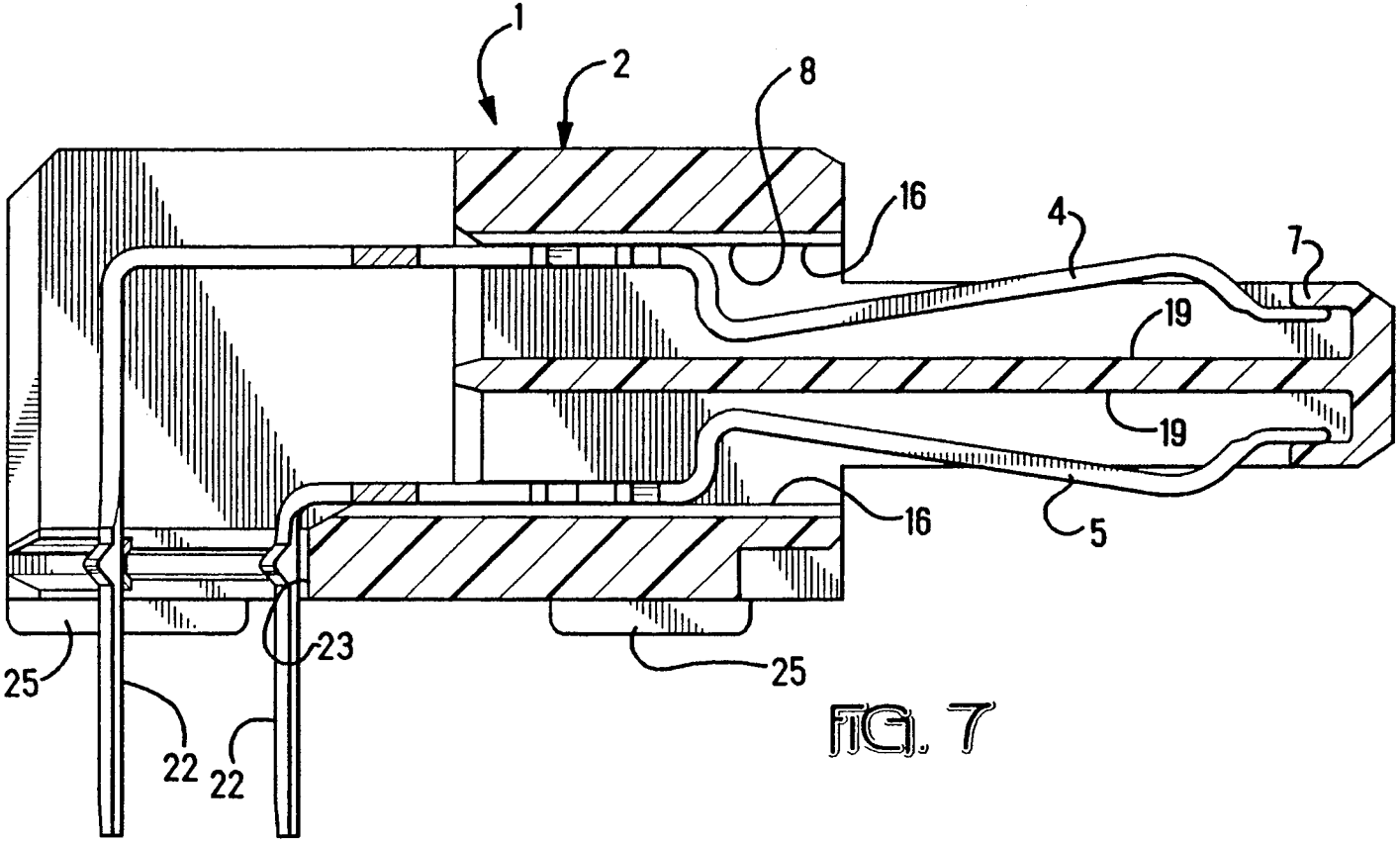
FIG. 7 is a view similar to FIG. 4 with the parts assembled together.

With reference to FIGS. 2–4, the body portion 17 has a thickness that is the same thickness as each of the contact fingers 9. The fingers 9 are bent to extend outward from the body portion 17 such that the thickness of the body portion 17 is in a plane perpendicular to a plane of thickness of each of the contact fingers 9. A termination 22 in the form of a pair of posts extend laterally downward of each body portion 17 for connection to a circuit board, not shown, and more particularly, for connection in plated apertures, not shown, of the circuit board. Each of the terminations 22 is larger in surface area and mass than that of each of the terminations 22 on the signal contacts 4, 5, thereby to conduct electrical current, and to radiate heat resulting from dissipation of electrical power.

The terminations 22 are on the signal contacts 4, 5 where they emerge from a rear of the divider 7. The terminations 22 are on the power contact 6 where it emerges from a rear of the divider 7. A series of slots 23 in the bottom wall 15 of the housing 2 have open ends communicating with a rear end 24 of the bottom wall 15. The terminations 22 project through the slots 23, with the terminations 22 of each pair 3 of the contacts 4, 5 being spaced apart along the same slot 23. The bottom wall 15 of the housing 2 provides a base from which knob shaped feet 25 extend for resting against a circuit board, not shown.

Figure 8:
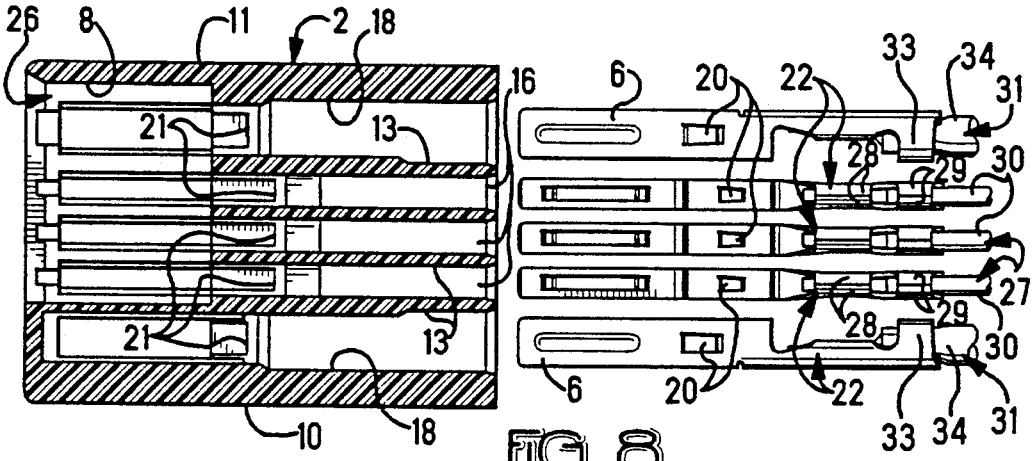
FIG. 8 is a section view of one of the connectors shown in FIG. 1 with parts separated from one another.

With reference to FIGS. 1 and 8–12, a cable connector 1 will be described. The cable connector 1 is adapted for mated connection with the version of the connector 1, FIGS. 2–7, for mounting on a circuit board, not shown. The divider 7 of the cable connector 1 is bifurcated by a passage 26 at the front mating end 12 for receiving the divider 7 of the version of the connector 1 for mounting on a circuit board, not shown. The grooves 19 face toward the passage 26, such that the contacts 4, 5 on opposite sides of the divider 7 face toward the passage 26. The pairs 3 of signal contacts 4, 5 are adapted to be connected to respective pairs 3 of signal wires 27 of a single electrical cable, not shown, or of multiple electrical cables, not shown. The signal wires 27 can be a twisted pair of signal wires 27. In FIG. 8, each of the signal contacts further comprises a termination 22 having arms 28 that extend outward laterally of each other, the arms being bendable into an open barrel configuration to encircle and connect with the signal wire 27. Another set of arms 29 extend laterally of each other, the arms 29 being bendable into an open barrel configuration to encircle and connect with insulation 30, FIG. 8, encircling the signal wire 27.

Figure 9:
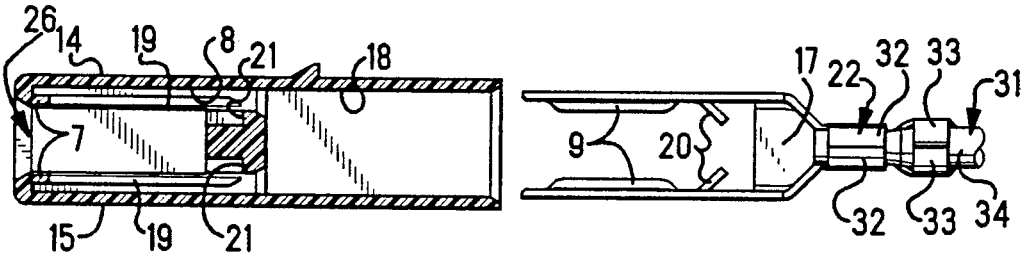
FIG. 9 is a section view of a portion of the connector shown in FIG. 8.
Figure 10:
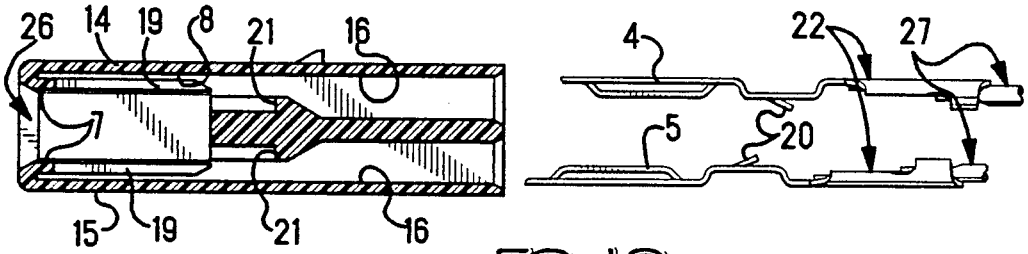
FIG. 10 is a section view of a portion of the connector shown in FIG. 8.
Figure 11:
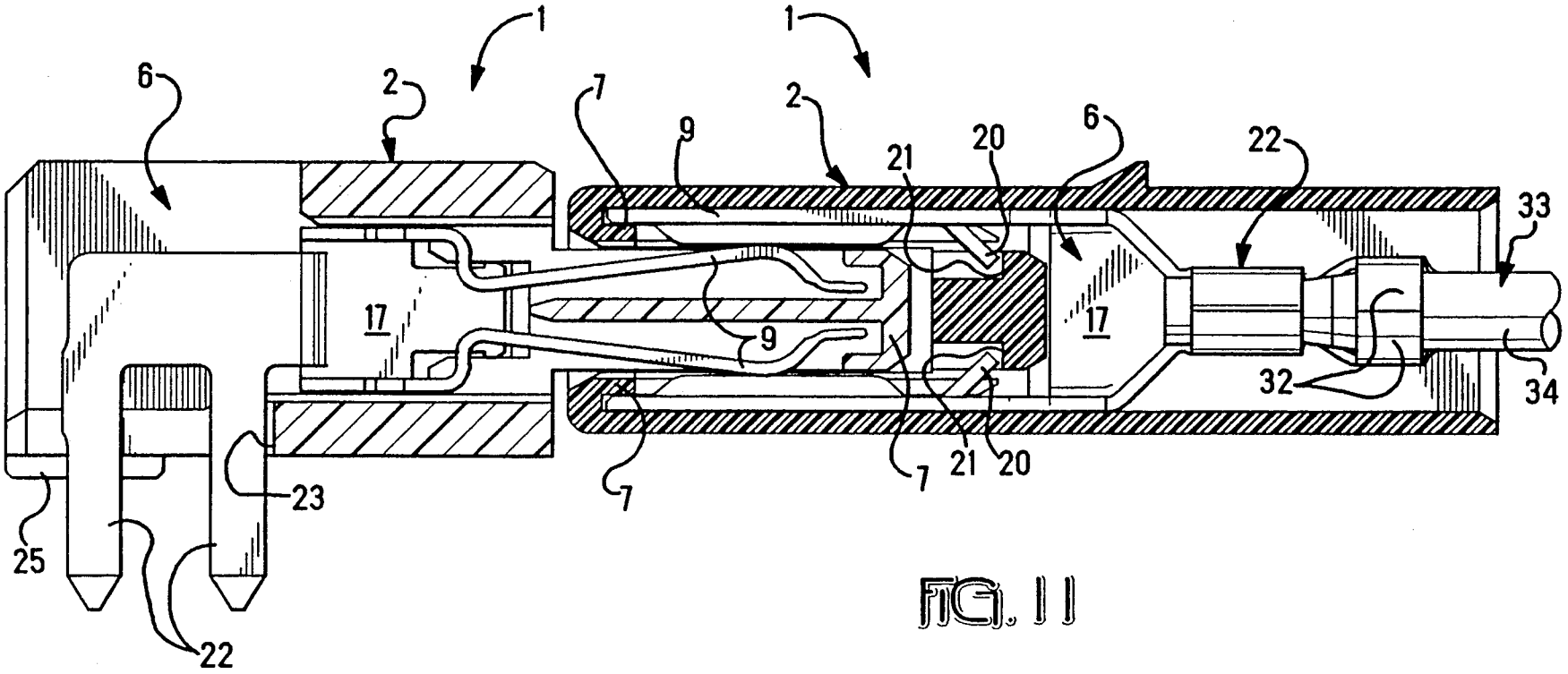
FIG. 11 is a section view of power contacts in the connectors shown in FIG. 1 in mated connection.
Figure 12:
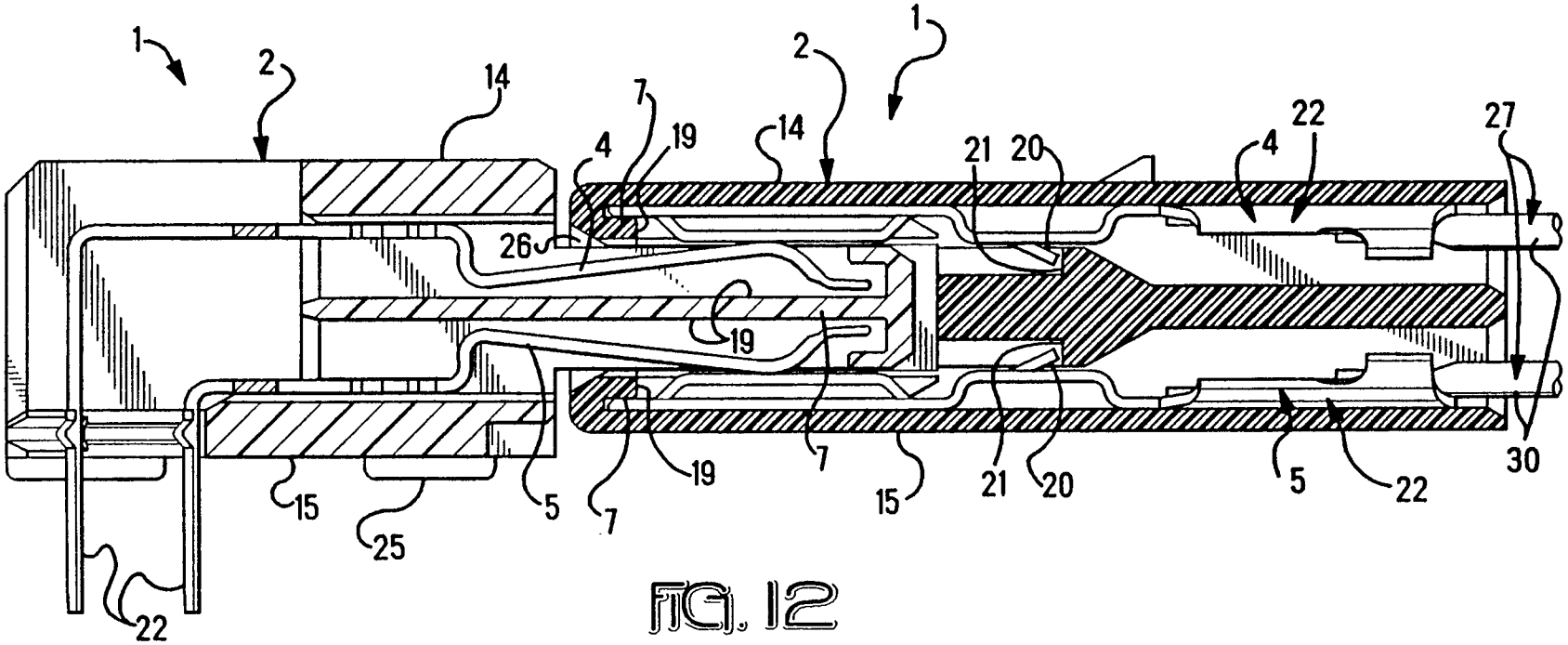
FIG. 12 is a section view of signal contacts in the connectors shown in FIG. 1 in mated connection.

With reference to FIGS. 8, 9 and 11, the contact fingers 9 extend from a connection to an electrical power transmitting wire 31 larger in diameter than each of the signal wires 27. The wire 31 may comprise an electrical power cable. In particular, the body portion 17 comprises a termination 22 having sets of arms 32, 33 that extend outward laterally of each other, the arms 32 being bendable into an open barrel configuration to encircle and connect with the electrical power transmitting wire 31. The wire 31 is larger in diameter than each of the signal wires 27 to carry electrical current. The signal wires 27 are smaller in diameter, as they are required to transmit electrical signals of which the voltage, not the electrical power, is of paramount importance. The set of arms 33 extend laterally of each other, and are bendable into an open barrel configuration to encircle and connect with insulation 34 encircling the wire 31.

An electrical connector 1 comprises both signal contacts 4, 5 and at least one power contact 6 in the same insulative housing 2. An electrical connector 1 is suitable for connection to twisted pair wires 4, 5 and to a conductor 31 of an electrical power cable. According to another embodiment, an electrical connector 1 is suitable for connection to both signal and power conductors routed on a circuit board.

Other advantages, and other embodiments and modifications of the invention are intended to be covered by the spirit and scope of the accompanying claims.

We claim:

1. An electrical connector comprising:

an insulative housing, multiple pairs of conductive signal contacts distributed along an insulative divider within an interior of the housing, the divider separating one of the signal contacts from the other of the signal contacts of each pair, and at least one conductive power contact having a pair of contact fingers on opposite sides of the divider, the contact fingers having a surface area sufficiently broad to radiate heat from electrical power dissipation, and the fingers extending parallel to the signal contacts in the cavity.

2. An electrical connector as recited in claim 1, comprising:

the fingers being connected to a body portion having a surface area sufficiently broad to radiate heat from electrical power dissipation, a pocket in the housing behind the divider receiving the body portion, and contact receiving cavities in the housing behind the divider receiving the contacts, each of the cavities being smaller than the pocket.

3. An electrical connector as recited in claim 1 wherein each of the fingers is of greater mass than each of the signal contacts.

4. An electrical connector as recited in claim 2, comprising:

the body portion having a thickness, and the contact fingers having the same thickness, and the fingers being bent to extend outward from the body such that the thickness of the body is in a plane perpendicular to a plane of each thickness of the contact fingers.

5. An electrical connector as recited in claim 4, comprising:

arms extending laterally of each body portion, the arms being bendable to encircle and connect with an electrical wire.

6. An electrical connector as recited in claim 1, wherein the signal contacts are distributed along opposite sides of the divider.

7. An electrical connector as recited in claim 1, wherein each pair of signal contacts are on opposite sides of the divider and are connected to a twisted pair of signal wires, and the fingers of the power contact are on opposite sides of the divider and are connected to a single wire larger in diameter than each of the signal wires.

8. An electrical connector as recited in claim 7 wherein each of the fingers is of greater mass than each of the signal contacts.

9. An electrical connector as recited in claim 7, comprising:

the fingers being connected to a body portion having a surface area sufficiently broad to radiate heat from electrical power dissipation, the body portion having a thickness, and the contact fingers having the same thickness, and the fingers being bent to extend outward from the body such that the thickness of the body is in a plane perpendicular to a plane of each thickness of the contact fingers.

10. An electrical connector as recited in claim 7, comprising:

arms extending laterally of each body portion, the arms being bendable to encircle and connect with an electrical wire.

11. An electrical connector as recited in claim 7, wherein the signal contacts are distributed along opposite sides of the divider.

12. An electrical connector comprising:

an insulative housing, multiple pairs of conductive signal contacts distributed along an insulative divider within an interior of the housing and adapted to be connected to respective pairs of signal wires, at least one conductive power contact having a pair of contact fingers on opposite sides of the divider, the contact fingers having a surface area sufficiently broad to radiate heat from electrical power dissipation, and the fingers of the power contact are on opposite sides of the divider and are connected to a wire larger in diameter than each of the signal wires.

13. An electrical connector as recited in claim 12, wherein, each pair of signal contacts are on opposite sides of the divider.

14. An electrical connector as recited in claim 12, wherein the fingers are parallel to the signal contacts.

* * * * *